US010744508B1

(12) United States Patent
Chang

(10) Patent No.: US 10,744,508 B1
(45) Date of Patent: Aug. 18, 2020

(54) AUTO-FEED PAPER SHREDDER HAVING LOCKABLE DOOR

(71) Applicant: Herman Chang, Rancho Dominguez, CA (US)

(72) Inventor: Herman Chang, Rancho Dominguez, CA (US)

( * ) Notice: Subject to any disclaimer, the term of this patent is extended or adjusted under 35 U.S.C. 154(b) by 332 days.

(21) Appl. No.: 15/282,614

(22) Filed: Sep. 30, 2016

(51) Int. Cl.
*B02C 18/00* (2006.01)
*B02C 25/00* (2006.01)
*B02C 18/14* (2006.01)

(52) U.S. Cl.
CPC ..... *B02C 18/0007* (2013.01); *B02C 18/142* (2013.01); *B02C 25/00* (2013.01)

(58) Field of Classification Search
CPC ..... B02C 18/0007; B02C 25/00
USPC ..... 241/100, 236
See application file for complete search history.

(56) References Cited

U.S. PATENT DOCUMENTS 4,944,461 A * 7/1990 Farnsworth ..... B02C 18/0007 241/100
5,362,002 A 11/1994 Tsai
5,884,855 A 3/1999 Chang
8,074,912 B2 12/2011 Chang
8,167,223 B2 * 5/2012 Jensen ..... B02C 18/0007 241/100
2012/0280070 A1 * 11/2012 Wang ..... B02C 18/0007 241/33

FOREIGN PATENT DOCUMENTS

JP 07016486 A * 1/1995

* cited by examiner

*Primary Examiner* — Teresa M Ekiert
*Assistant Examiner* — Jared O Brown
(74) *Attorney, Agent, or Firm* — Stefan J. Kirchanski; Matthew J. Spark; Zuber Lawler & Del Duca LLP

(57) ABSTRACT

Auto-feeding paper shredders use auto-feed mechanisms to remove sheets of paper from a large stack and shred them without human assistance or intervention. Once the document owner inserts the stack of confidential documents and leaves the scene, others are free to access the stack and read or remove confidential documents. This problem by providing a locked shredding compartment to hold the stack while shredding is taking place. An electronically operated lock that can be locked and unlocked by entering a PIN (personal identification number) through a key pad or a series of buttons or switches. Fingerprints or other biometric factors can also be used to control the lock.

16 Claims, 4 Drawing Sheets

AUTO-FEED PAPER SHREDDER HAVING LOCKABLE DOOR

CROSS-REFERENCE TO PRIOR APPLICATIONS

Not Applicable

U.S. GOVERNMENT SUPPORT

Not Applicable

BACKGROUND OF THE INVENTION

Area of the Art

The present invention involves paper shredders and more specifically designs to prevent theft of documents by locking access to the paper shredder.

Background Description

Modern paper shredders for shredding documents generally incorporate counter rotating shafts bearing blades and spacers so that paper passing between the rotating blades is effectively shredded. The maximum sheet capacity of such paper shredders is dependent on the power of the motor and the strength limitations of the cutting blades and rotary shafts. Although many units can handle small stacks of 10-20 sheets, when a larger quantity of paper must be destroyed, the user needs to stand by the unit and continuously feed the machine small stacks of paper that are within the maximum sheet capacity of the unit. If even a relatively small number of sheets are to be shredded, it is usually necessary for the user to get up and walk to the shredder because most units must be fed relatively small quantities of paper at one time—that is, they cannot handle large stacks of paper.

The problem of conveniently shredding large stacks can be solved by paper shredders equipped with an auto-feed mechanism that enables automatic feeding of the paper shredder with single sheets or small stacks of sheets taken from larger. U.S. Pat. No. 5,362,002, the contents of which are incorporated herein by reference, discloses a paper shredder with automatic paper feeding mechanism. The feeding device includes an angled tray which is mounted to the device top adjacent the shredding roller assembly, a rotary shaft which is mounted rotatably on the tray, a tension spring which is connected to the rotary shaft and the tray, and at least one push rod, each of which having two pivotally connected rod sections. The device operates by feeding one or a few sheets of paper from the top of the paper stack in the tray into the throat of the shredder. A similar arrangement is found in U.S. Pat. No. 5,884,855, also incorporated herein by reference, which discloses a paper feed structure for paper shredders having a paper containing tray and paper feed adjustment device. Both of these auto-feeding devices simulate the manual feeding of paper into a shredder and both of them depend on an external tray which increases the overall height and profile of the unit.

What is really needed is a shredder with an integral auto-feed system. A good example is disclosed in U.S. Pat. No. 8,074,912, the content of which is incorporated herein by reference, wherein the paper shredder includes a driving roller assembly at the bottom of a paper compartment and a hinged top for closing the paper compartment and providing downward pressure on the stack of paper located within the compartment. The driving roller assembly includes a spaced apart pair of counter-rotating feeding rollers which extend through an opening in the bottom of the paper compartment to contact and grab a sheet of paper from the bottom of a stack of paper that has been placed in the compartment. The sheet is grabbed near its center and pulled between the rollers and then pushed into the shredding mechanism. When the compartment is empty, one or more sheets of paper can be pushed through a slot in the hinged top directly between the feeding rollers and into the shredding mechanism. Thus, this unit can function either as an auto-feed unit which shreds a large stack of sheets placed in the compartment or, when the compartment is empty, as a conventional paper shredder by inserting sheets directly into the shredding mechanism.

It will be appreciated that such any of the above-mentioned auto-feed devices are great time savers. Rather than having to stand next to a shredder and feed in documents a few at a time, a user can load the unit with a pile of confidential documents to be shredded and return to some other work task (or even a leisure activity). The real problem presented by any auto-feed paper shredder is that it takes stacks of documents (a highly desirable feature) which represent a security breach if the stack is left unattended. The entire purpose of the paper shredder is to ensure that confidential documents do not fall into the wrong hands. However, if one loads an auto-feed shredder with documents and leaves the location of the shredder, there is considerable danger of confidentiality being breached. The current invention provides a solution to this problem.

SUMMARY OF THE INVENTION

Paper shredders are used as security measures to prevent the reading of confidential information on discarded documents. A problem with a conventional paper shredder is that it will only shred a relatively small number of documents at one time. Therefore, if a large stack of confidential documents is to be shredded, a person must stand by the shredder and feed in small lots of documents until the entire stack has been destroyed. While having a person supervise the shredding process is a good way to ensure secrecy and avoid the unshredded documents from falling into the wrong hands, it is a very poor use of talented office personnel. One alternative to slow feeding of documents is to use a remote document shredding service. Such services provide "secure" bins to accept sensitive documents. There bins are periodically collected and the documents are processed at a remote shredding site. Of course, the problem with this approach is the document owner is forced to trust the security of the delivery system and the remote shredder facility. Many document owners are unwilling to accept the risks of such a system.

Presently, a generation of auto-feeding paper shredders has been developed. These devices use a variety of different auto-feed mechanisms to remove sheets of paper from a large stack and shred them without human assistance or intervention. The obviates the need for a skilled person to waste hours feeding documents to the shredder. However, auto-feed systems do not solve the inherent security problems. Once the document owner inserts the stack of confidential documents and leaves the scene, others are free to access the stack and read or remove confidential documents. The inventive auto-feed shredder solves this problem by providing a locked shredding compartment to hold the stack while shredding is taking place. The user simply inserts the stack of papers and closes the lid to the shredding compartment. The compartment lid locks and the shredding process commences. When all of the confidential documents have been destroyed. The lid unlocks and can be opened to deposit additional documents in the shredding compartment. A slot is conveniently provided in the lid so that single sheets of paper can be inserted into the shredding mechanism when the compartment is not filled with a stack of paper.

A preferred design includes an electronically operated lock that can be locked and unlocked by entering a PIN (personal identification number) through a key pad or a series of buttons or switches. It is also possible to provide a touch screen for operation of the lock. With a screen or with appropriate touch sensitive scanners, fingerprints or other biometric factors can be used to control the lock. Key fobs, RFID (radio-frequency identification) cards, magnetic strip cards, chip-enabled cards or cards with optically scannable codes can also be used as keys. Smart phones or similar handheld devices can also be used as keys when equipped with appropriate security software. The handheld devices communicate with the shredder by WiFi, Bluetooth or NFC (near field communication), all of which are built-in to most handheld devices. In addition, many handheld devices contain fingerprint or other biometric sensors making it easier to control security. It will be appreciated that biometric security methods are the most secure. Physical keys such as cards or fobs are less secure because they can be lost or stolen. Combining physical keys with a PIN provide an improved level of security over physical keys alone.

DETAILED DESCRIPTION OF THE INVENTION

Figure 1:
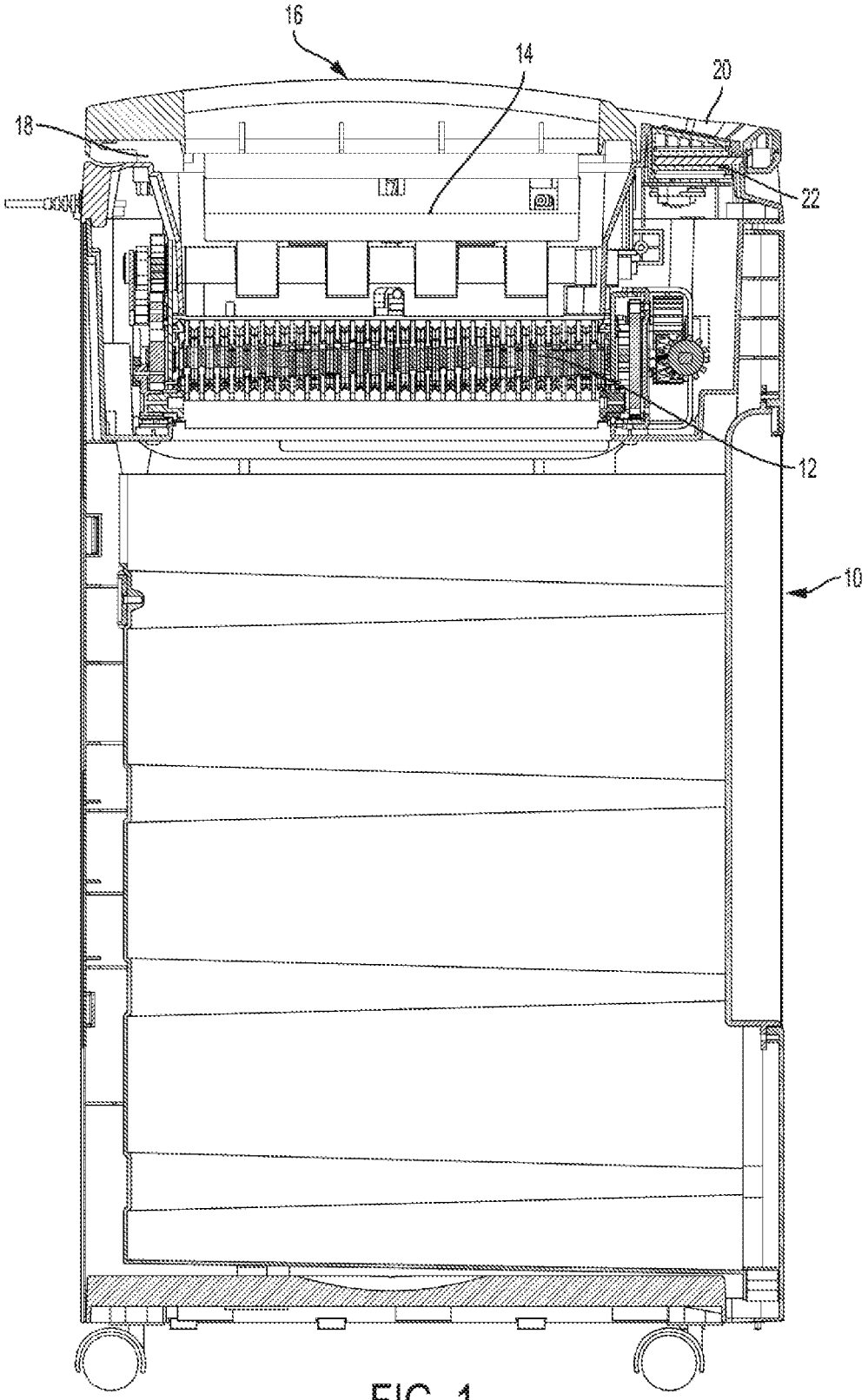
FIG. 1 is a diagram of the unit in the unlocked state.

The following description is provided to enable any person skilled in the art to make and use the invention and sets forth the best modes contemplated by the inventor of carrying out his invention. Various modifications, however, will remain readily apparent to those skilled in the art, since the general principles of the present invention have been defined herein specifically to provide an auto-feeding paper shredder having a door locking mechanism for security.

The bottom feeding auto-feed shredder is equipped with a lid or door to apply pressure to the stack of documents, thereby facilitating document gripping by the feed apparatus. It is, therefore, relatively simple to add a locking mechanism to the door so as to prevent accidental divulging of confidential information. Other types of auto-feed shredders can also be equipped with doors or enclosures to protect the unattended documents. It is relatively simple to equip the shredder door with a mechanical lock and key of some type. The range of possibilities is quite large. One can imagine a simple hasp system with a padlock. The padlock could be opened with a classic metal key. Alternatively, it could be a combination lock operated by a dial or push-buttons.

Although such a system can be effective, a separate padlock is not very elegant for a piece of office equipment. Furthermore, the key or padlock can easily be lost or misplaced thereby leaving the shredder unprotected. The problem of losing the lock can easily be avoided by building a typical mechanical key and lock set into the shredder. However, the mechanical key can still be lost. A reasonable solution is to provide an electronically operated lock with control of the "key" being provided by the microcontroller that operates the entire shredding mechanism. Actual physical "keys" can be provided that operate either on an optical scanning principle or a radio transmission principle (like RFID tags or automobile key fobs). Alternatively, some type of "combination lock" can be provided where the user enters the combination on a keypad or the like. This combination can easily be user configurable so that the authorized users can have an opening code known only to them.

An even more secure key is a biometric key provided by, for example a fingerprint or a retina scan. Retina scans are still a bit "science fiction" but fingerprint scanners are readily available. In any case, the unit should also be equipped with a timeout function. The safest and most expeditious mode is to have the door automatically unlock as soon as the stack of papers has been entirely consumed. It is also possible to have a default unlock that opens the door after the shredder has been inactive for a predetermined period of time even if papers remain in the input tray. While somewhat less secure, such unlocking would indicate that something had interfered with the shredding process and would likely be accompanied by an alarm of some sort. If the unit is telling the user that something is wrong with the shredding process, it is probably not beneficial to require the user to fumble around attempting to unlock the shredder door. Similarly, if the shredder detects a paper jam, the user will be alerted and most probably the door should automatically unlock to facilitate clearing the jam. Of course, these choices can be user selectable so that in high security situations, the door will never unlock without the proper key or combination.

It should also be considered that the locking and unlocking processes can be handled in different ways. For example, while it would normally be required to use some sort of key to open a locked paper compartment door, the locking process can either also require the use of the key or be automatic. This can also be a user selectable feature.

FIG. 1 depicts a cross section through a locking auto-feed paper shredder of the present invention in a closed but unlocked configuration. The front of the unit is on the right side of the drawing while the rear is on the let side. The unit 10 is equipped with casters for ease of transport. Most of the lower region of the unit is empty and comprises a bin for receiving shredded paper fragments. A convention shredding mechanism 12 is disposed above the waste bin, and a paper compartment 14 for holding a stack of paper is disposed above the shredding mechanism 12 so that the auto-feeder can remove sheets from the bottom of the stack and feed them to the mechanism 12. The paper compartment 14 is closed by a lid 16. The lid has a hinge 18 at its back end and a handle 20 at its front end.

Figure 2:
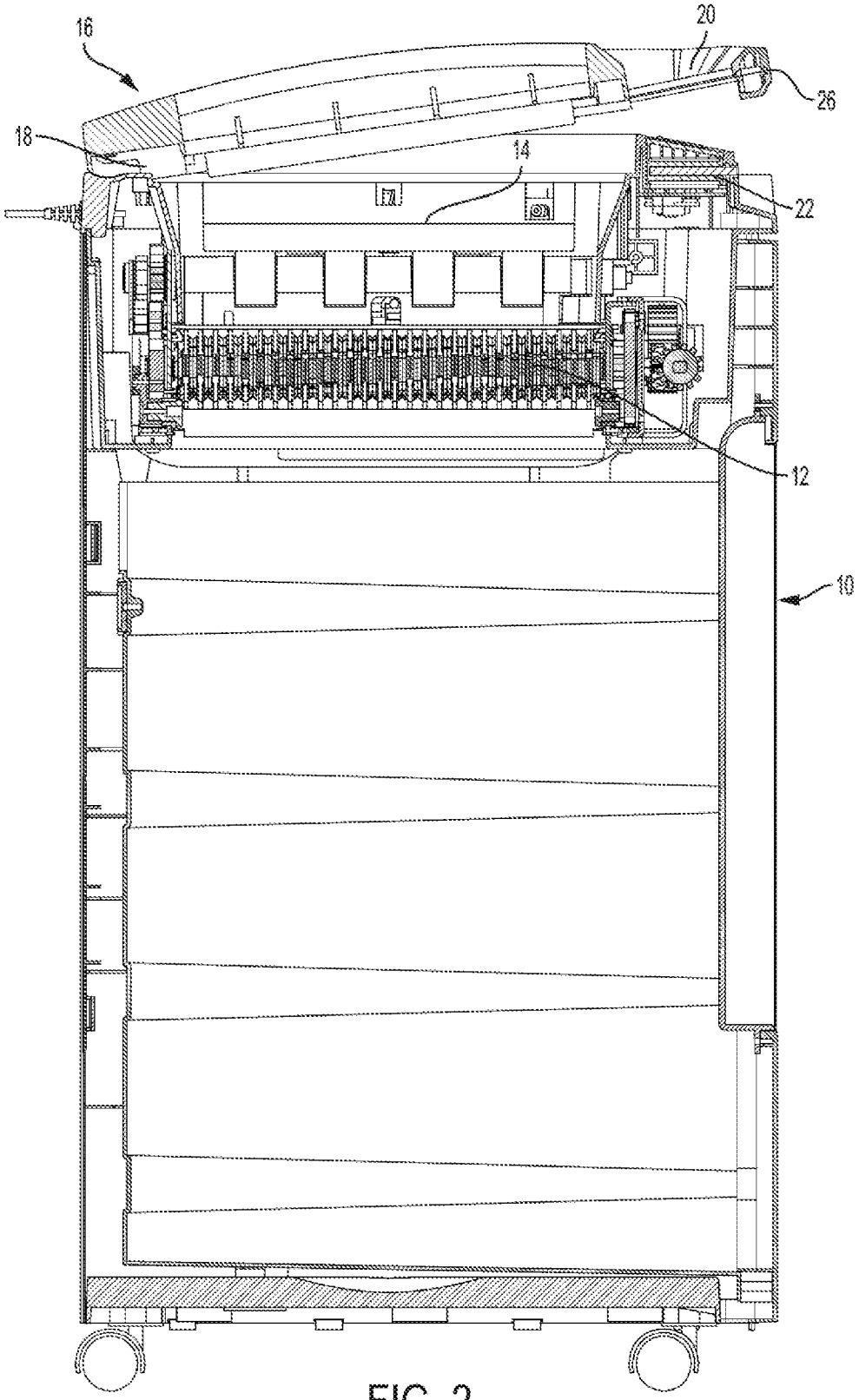
FIG. 2 is diagram of the unlocked unit with the lid partially opened.
Figure 3:
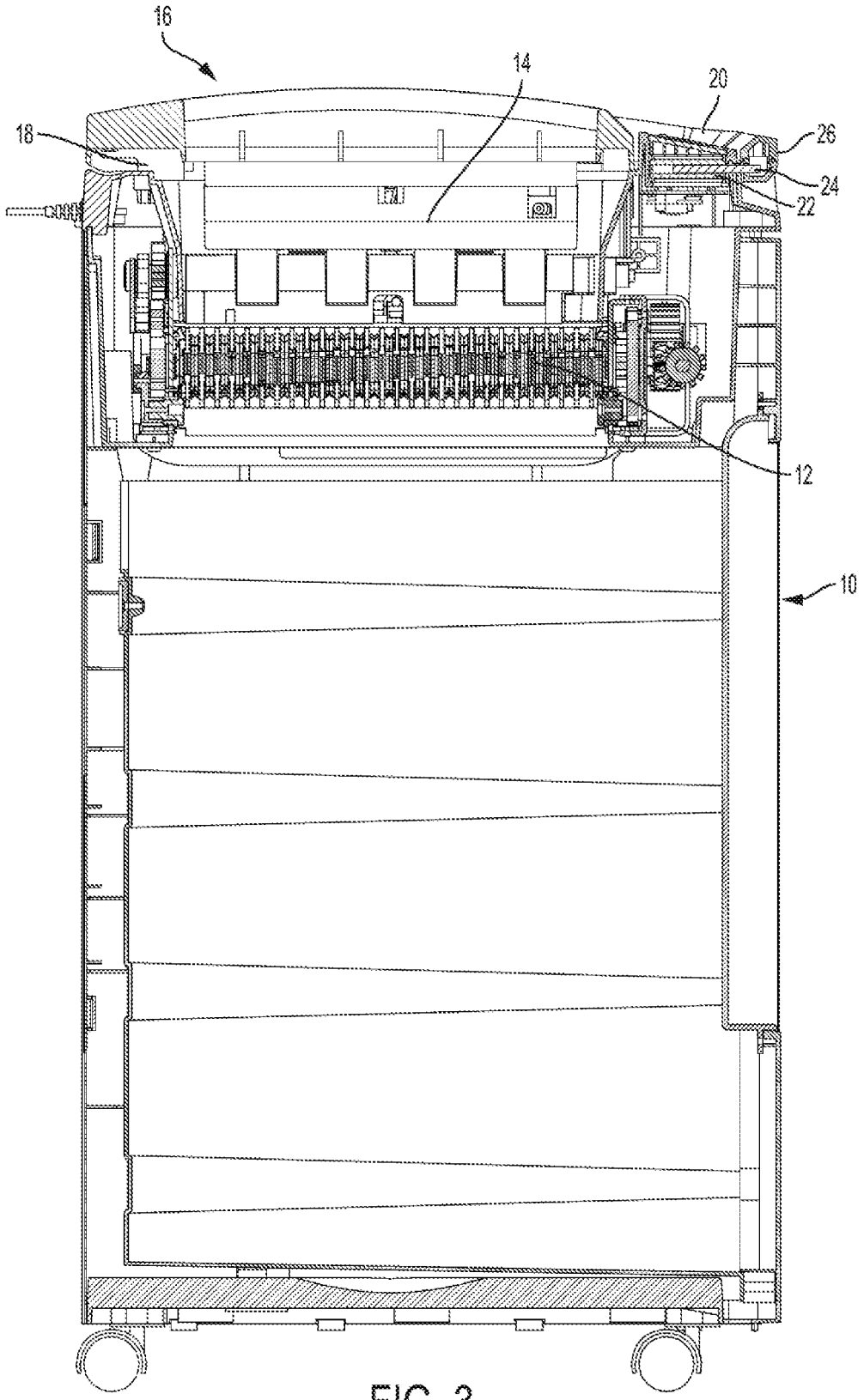
FIG. 3 is a diagram of the unit with the lid closed and the locking mechanism engaged.

A locking mechanism 22 exists at the handle end of the lid and comprises a bolt 22 and a catch 26. FIG. 2 shows the lid partially opened while FIG. 3 shows the unit closed and locked. Note that the bolt 22 now penetrates the catch 26 thereby preventing the lid from opening. Although there are a number of ways of implementing such a lock, the illustrated system provides a solenoid magnet to pull the bolt 22 out of the catch 26. The system is equipped with a spring to ensure that the lid remains locked even if the unit is unplugged from the power. With this arrangement, an active signal is required to unlock the lid. It will be appreciated that a variety of alternative implementations could be used.

Figure 4:
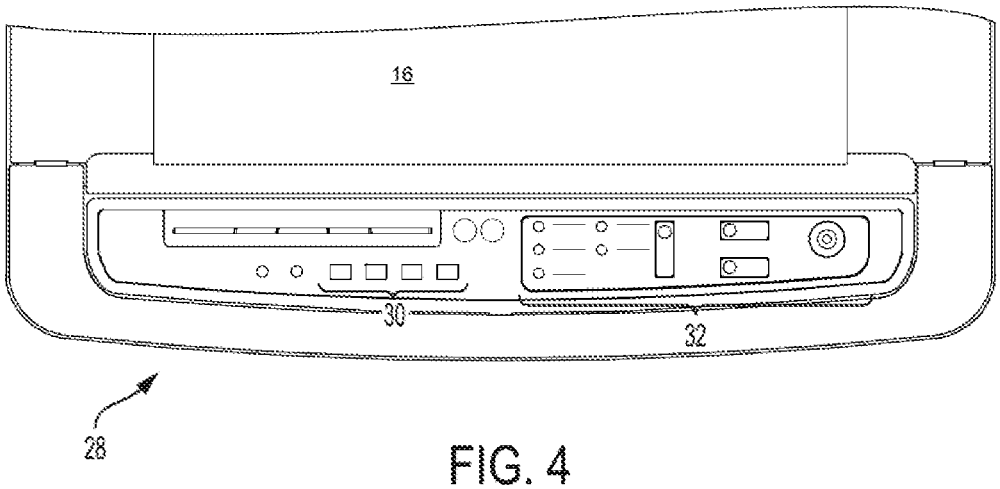
FIG. 4 is diagram of the control panel showing the input buttons for the locking mechanism.

FIG. 4 shows the control panel 28 for the paper shredder 10. This panel is located on the front edge of the lid 16. Controls 32 are the usual paper shredder controls ("ON," "OFF," "REVERSE," etc. Controls 30 are four buttons for entering the unlock PIN to unlock the lid. By pressing the buttons, one can cycle through a number setting for each button until the user selectable lock/unlock code is input. Normally, if the paper compartment 14 is empty, the lid will either be freely openable or will unlock a the touch of an unlock button. Even when the paper compartment 14 is empty, it is possible to use the lock/unlock code to lock the lid so as to prevent unauthorized use. When the paper compartment 14 has paper in it, the shredder starts up and the lid locks (or no longer responds to the unlock button). The lid remains locked until all the paper has been shred at which time it unlocks or becomes openable by pressing an unlock button. If a paper jam occurs during shredding, the shredder stops and the lid unlocks so that an operator can clear the paper jam. If the papers being shredded contain particularly sensitive information, the unit can be set to remain locked until someone with the lock/unlock code arrives.

The following claims are thus to be understood to include what is specifically illustrated and described above, what is conceptually equivalent, what can be obviously substituted and also what essentially incorporates the essential idea of the invention. Those skilled in the art will appreciate that various adaptations and modifications of the just-described preferred embodiment can be configured without departing from the scope of the invention. The illustrated embodiment has been set forth only for the purposes of example and that should not be taken as limiting the invention. Therefore, it is to be understood that, within the scope of the appended claims, the invention may be practiced other than as specifically described herein.

What is claimed is:

1. An auto-feed paper shredder with improved security features comprising:

a paper shredding mechanism for accepting and shredding sheets of paper;

a paper compartment for holding a stack of paper sheets placed in said compartment to be fed into the paper shredding mechanism;

a lid moveable between an open position and a closed position, wherein the paper compartment is accessible when the lid is in the open position, and the paper compartment is not accessible when the lid is in the closed position;

a lid lock configured to retain the lid in the closed position when the paper shredder is unpowered;

input controls configured for inputting the lock or unlock instruction to the lock; wherein the input controls include a default unlock option configured to unlock the lid lock after the paper shredding mechanism has been inactive for a predetermined period of time.

2. The auto-feed paper shredder according to claim 1, wherein the instruction is a personal identification number.

3. The auto-feed paper shredder according to claim 1, wherein the input controls are present on the lid.

4. The auto-feed paper shredder according to claim 1, wherein the input controls are configured to allow the user to disable the default unlock option.

5. An auto-feed paper shredder with improved security features comprising:

a paper shredding mechanism for accepting and shredding sheets of paper;

a paper compartment for holding a stack of paper sheets placed in said compartment to be fed into the paper shredding mechanism;

a lid moveable between an open position and a closed position, wherein the paper compartment is accessible when the lid is in the open position, and the paper compartment is not accessible when the lid is in the closed position;

a lid lock configured to automatically unlock upon an occurrence of at least one condition;

input controls disposed on the lid, and configured to allow a user to set the at least one condition upon which the occurrence during operation of the shredder will cause the lid lock to automatically unlock; wherein the input controls include a default unlock option configured to unlock the lid lock after the paper shredding mechanism has been inactive for a predetermined period of time.

6. The auto-feed paper shredder according to claim 5, wherein the input controls are configured to allow the user to disable the default unlock option.

7. The auto-feed paper shredder according to claim 5, wherein the input controls are configured to provide the user with options to automatically lock the lid lock upon the lid moving into the closed position or require use of a key to lock/unlock the lid lock when the lid is in the closed position.

8. The auto-feed paper shredder according to claim 5, wherein the input controls includes another default unlock option configured to unlock the lid lock after a paper jam has been detected.

9. The auto-feed paper shredder according to claim 8, wherein the input controls are configured to allow the user to disable the default unlock option.

10. An auto-feed paper shredder with improved security features comprising:

a paper shredding mechanism for accepting and shredding sheets of paper;

a paper compartment for holding a stack of paper sheets placed in said compartment to be fed into the paper shredding mechanism;

a lid moveable between an open position and a closed position, wherein the paper compartment is accessible when the lid is in the open position, and the paper compartment is not accessible when the lid is in the closed position;

a lid lock configured to retain the lid in the closed position when the paper shredder is unpowered;

a lock or unlock instruction or unlock instruction to the lock; wherein the input controls include a default unlock option configured to unlock the lid lock after a paper jam has been detected.

11. The auto-feed paper shredder according to claim 10, wherein the instruction is a personal identification number.

12. The auto-feed paper shredder according to claim 10, wherein the input controls are present on the lid.

13. The auto-feed paper shredder according to claim 10, wherein the input controls are configured to allow a user to disable the default unlock option.

14. An auto-feed paper shredder with improved security features comprising:

a paper shredding mechanism for accepting and shredding sheets of paper;

a paper compartment for holding a stack of paper sheets placed in said compartment to be fed into the paper shredding mechanism;

a lid moveable between an open position and a closed position, wherein the paper compartment is accessible when the lid is in the open position, and the paper compartment is not accessible when the lid is in the closed position;

a lid lock configured to automatically unlock upon an occurrence of at least one condition;

input controls disposed on the lid, and configured to allow a user to set the at least one condition upon which the occurrence during operation of the shredder will cause the lid lock to automatically unlock; wherein the input controls include a default unlock option configured to unlock the lid lock after a paper jam has been detected.

15. The auto-feed paper shredder according to claim 14, wherein the input controls are configured to allow the user to disable the default unlock option.

16. The auto-feed paper shredder according to claim 14, wherein the input controls are configured to provide the user with options to automatically lock the lid lock upon the lid moving into the closed position or require use of a key to lock/unlock the lid lock when the lid is in the closed position.

* * * * *